US009995296B2

(12) United States Patent
Hayes-Pankhurst et al.

(10) Patent No.: US 9,995,296 B2
(45) Date of Patent: Jun. 12, 2018

(54) PUMPS

(71) Applicant: Quantex Patents Limited, London (GB)

(72) Inventors: Richard Paul Hayes-Pankhurst, London (GB); Jonathan Edward Ford, Cambridge (GB)

(73) Assignee: QUANTEX PATENTS LIMITED, London (GB)

( * ) Notice: Subject to any disclaimer, the term of this patent is extended or adjusted under 35 U.S.C. 154(b) by 229 days.

(21) Appl. No.: 14/772,877

(22) PCT Filed: Mar. 5, 2014

(86) PCT No.: PCT/EP2014/054215
§ 371 (c)(1),
(2) Date: Sep. 4, 2015

(87) PCT Pub. No.: WO2014/135563
PCT Pub. Date: Sep. 12, 2014

(65) Prior Publication Data

US 2016/0010634 A1 Jan. 14, 2016

(30) Foreign Application Priority Data

Mar. 5, 2013 (GB) ..... 1303903.7

(51) Int. Cl.
*F04B 43/08* (2006.01)
*F04B 53/10* (2006.01)
(Continued)

(52) U.S. Cl.
CPC ..... *F04B 43/08* (2013.01); *F04B 23/12* (2013.01); *F04B 43/0072* (2013.01);
(Continued)

(58) Field of Classification Search
CPC ..... F04B 23/12
(Continued)

(56) References Cited

U.S. PATENT DOCUMENTS 3,216,362 A * 11/1965 Hewko ..... F04B 43/14 417/475
3,618,856 A * 11/1971 Sachnik ..... A01G 13/0287 239/343
(Continued)

FOREIGN PATENT DOCUMENTS

DE 2258001 A 5/1974
EP 2383553 11/2012
(Continued)

*Primary Examiner* — Peter J Bertheaud
*Assistant Examiner* — Geoffrey Lee

(57) ABSTRACT

A pump is formed by a housing (10) having an inlet (11) and an outlet (12) for a fluid. The housing (10) contains a rotator (13) provided with at least one surface recess (17*a*, 17*b*, 17*c*, 17*d*) that forms with an interior surface of the rotor a chamber (18*a*, 18*b*, 18*c*, 18*d*) that, on rotation of the rotor (13), conveys fluid from the inlet (11) to the outlet (12). A flexible seal (23) is provided on or as part of the housing (10) and is located between the inlet (11) to the outlet (12) to engage the rotor (13) to prevent fluid passing from the outlet (12) to the inlet (11). A second inlet (16) is provided leading to the outlet (12) for the supply to the outlet (12) of a second fluid and the second inlet (16) also supplies the second fluid to the back of the seal (23) to urge the seal (23) against the rotor (13).

19 Claims, 3 Drawing Sheets

Figure 1:
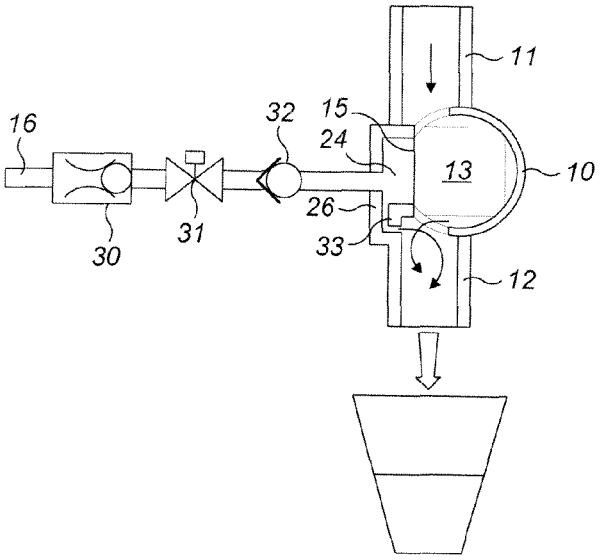

(51) Int. Cl.

| | |
|---|---|
| ***F04B 53/16*** | (2006.01) |
| ***F04B 49/22*** | (2006.01) |
| ***F04C 5/00*** | (2006.01) |
| ***F04B 23/12*** | (2006.01) |
| ***F04C 15/00*** | (2006.01) |
| ***F04B 43/00*** | (2006.01) |

(52) U.S. Cl.
CPC ..... *F04B 49/22* (2013.01); *F04B 53/10* (2013.01); *F04B 53/16* (2013.01); *F04C 5/00* (2013.01); *F04C 15/0015* (2013.01); *F04C 2220/24* (2013.01)

(58) Field of Classification Search
USPC ..... 417/156; 418/125, 754; 222/133, 136, 222/145.5, 135
See application file for complete search history.

(56) References Cited

U.S. PATENT DOCUMENTS 3,771,901 A * 11/1973 Svensson ..... F04C 5/00 418/156
4,904,168 A * 2/1990 Cavoto ..... A61F 9/00736 417/475
5,009,573 A * 4/1991 Ring, Sr. ..... F04B 43/1276 417/475
5,814,004 A * 9/1998 Tamari ..... A61M 1/0031 251/10
6,039,078 A * 3/2000 Tamari ..... A61M 1/0031 138/30
7,674,100 B2 * 3/2010 Hayes-Pankhurst ..... A61M 5/14232 418/125
9,638,204 B2 * 5/2017 Hayes-Pankhurst .... F04D 29/08
2006/0051228 A1 * 3/2006 Hayes-Pankhurst ..... A61M 5/14232 418/61.2
2007/0031558 A1 * 2/2007 Lussi ..... A47J 31/402 426/520
2007/0036688 A1 * 2/2007 Hayes-Pankhurst ... A45D 34/02 422/124
2010/0129248 A1 * 5/2010 Mou ..... F04B 43/1284 417/477.9
2012/0034122 A1 * 2/2012 Hayes-Pankhurst ..... F01C 5/04 418/129
2012/0285992 A1 * 11/2012 Ciavarella ..... F04C 13/00 222/138
2013/0020410 A1 * 1/2013 Conrad ..... B05B 7/0408 239/290
2014/0255164 A1 * 9/2014 Hayes-Pankhurst ..... B67D 1/10 415/170.1
2014/0348684 A1 * 11/2014 Hayes-Pankhurst ..... F01C 5/04 418/129
2015/0260195 A1 * 9/2015 Hayes-Pankhurst ..... F04C 5/00 415/173.1
2016/0010634 A1 * 1/2016 Hayes-Pankhurst ..... F04C 5/00 417/53
2016/0010643 A1 * 1/2016 Hayes-Pankhurst .. F01C 1/3566 418/139
2016/0010644 A1 * 1/2016 Hayes-Pankhurst ..... F04C 5/00 418/125

FOREIGN PATENT DOCUMENTS

GB 1495797 A 12/1977
WO WO2006/027548 3/2006
WO WO2012/154642 11/2012

* cited by examiner

PUMPS

CROSS-REFERENCE TO RELATED APPLICATIONS

This application is the United States National Phase of Patent Application No. PCT/EP2014/054215 filed 5 Mar. 2014, which claims priority to British Patent Application No. 1303903.7 filed 5 Mar. 2013, each of which is incorporated herein by reference.

BACKGROUND OF THE INVENTION

The invention relates to pumps.

It is known to provide a pump formed by a housing having an inlet and outlet for a fluid and containing a rotor provided with at least one surface recess that forms with the interior surface of the rotor a chamber that, on rotation of the rotor, conveys fluid from the inlet to the outlet. In order to prevent fluid passing from the outlet to the inlet, a flexible seal is provided on or as part of the housing and is located between the inlet and the outlet. The seal is urged into engagement with the rotor by a spring, which can take many forms such as a block of resilient material or a resilient tube of material or a spring. Pumps of this general kind are disclosed in WO2006/027548.

There can be a requirement to add a second fluid to a pumped fluid. For example, a drink concentrate may require dilution with water before it can be consumed or detergents might be added to a wash solution in car washes. Carbon dioxide might be added to drinks to carbonate them. Such a second fluid can be introduced into the pumped fluid as it passes through the outlet of a pump of the kind described above.

According to the invention, there is provided a pump formed by a housing having an inlet and an outlet for a fluid and containing a rotor provided with at least one surface recess that forms with the interior surface of the rotor a chamber that, on rotation of the rotor, conveys fluid from the inlet to the outlet, a flexible seal being provided on or as part of the housing and located between the inlet and the outlet to engage the rotor to prevent fluid passing from the outlet to the inlet, a second inlet being provided leading to the outlet for the supply to the outlet of a second fluid, the second inlet also supplying the second fluid to the seal to urge the seal against the rotor.

In this way, the requirement for a spring or other means for urging the seal against the rotor is obviated so simplifying the pump, making it more reliable and reducing its cost.

Figure 2:
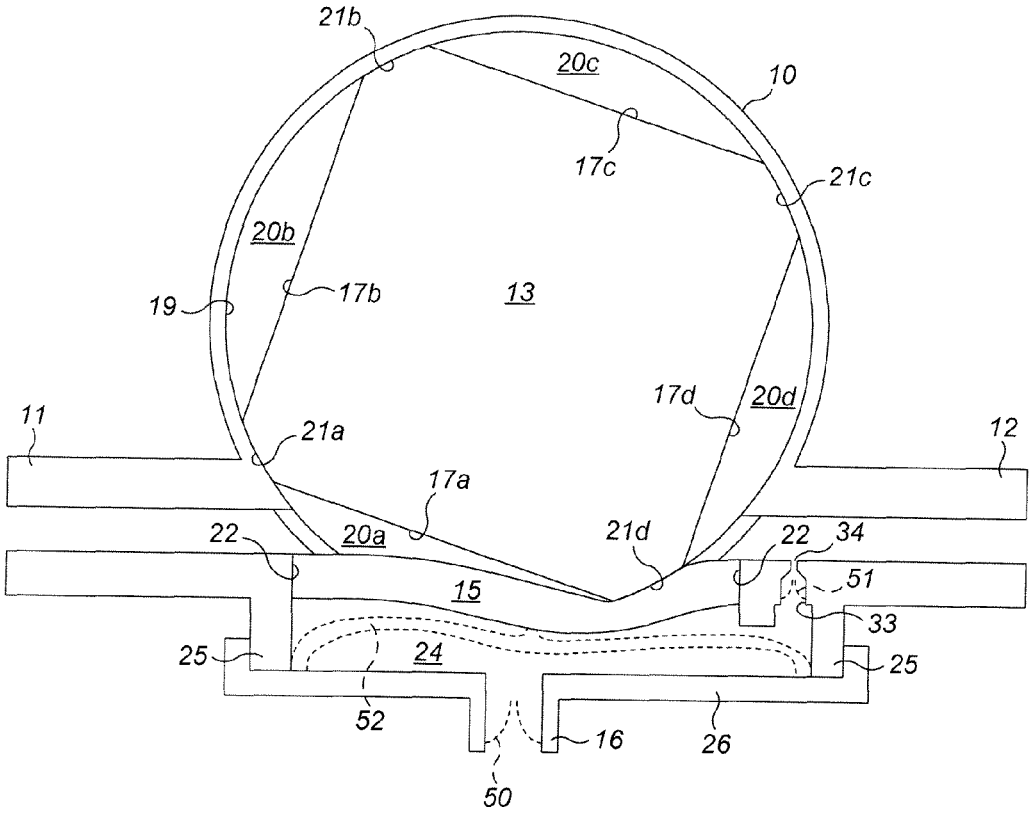
Figure 3:
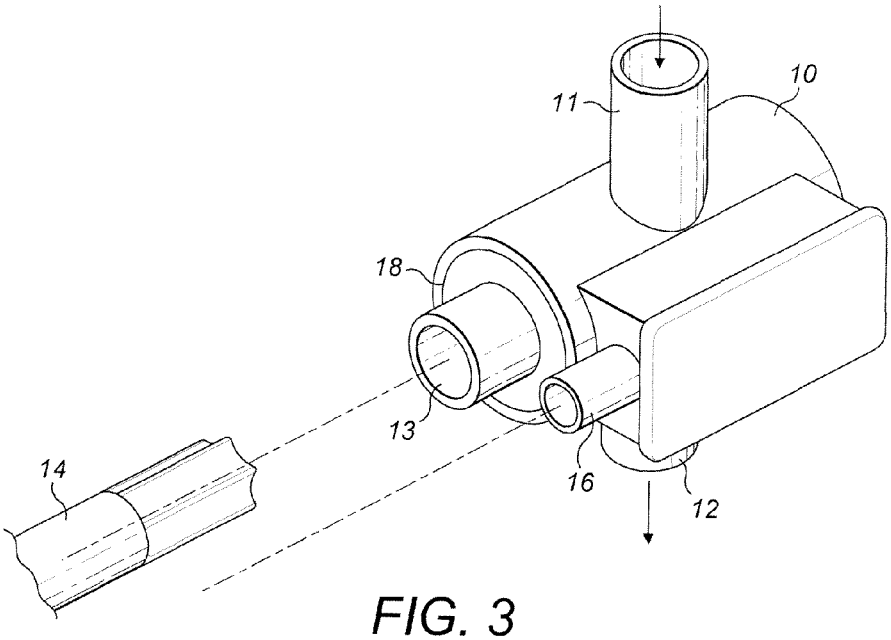
Figure 4:
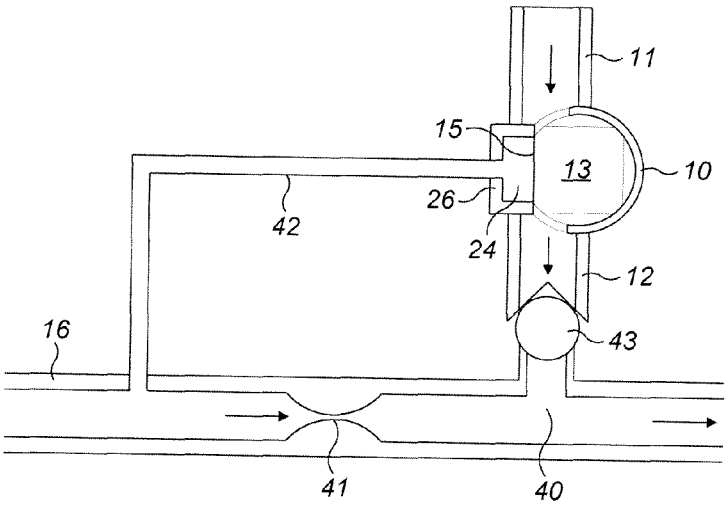
Figure 5:
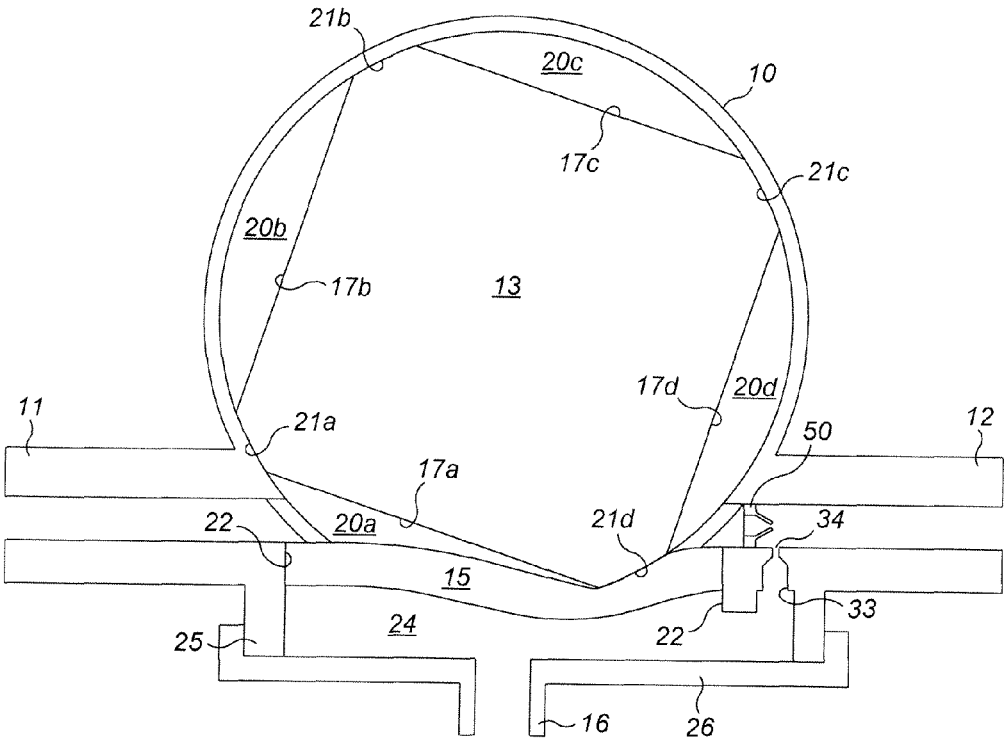

The following is a more detailed description of an embodiment of the invention, by way of example, reference being made to the accompanying drawings, in which:

FIG. 1 is a schematic cross-sectional view of a first form of pump including a housing, a rotor, first and second inlets and an outlet, FIG. 2 is an expanded view of the pump of FIG. 1, FIG. 3 is a schematic perspective view of the pump of FIGS. 1 and 2, FIG. 4 is a schematic view of an alternative form of pump, and FIG. 5 is a schematic cross-sectional view of the pump of FIGS. 1 to 4 including check valve in the outlet.

Referring first to FIGS. 1 to 3, the pump comprises a housing 10 with an inlet 11 and an outlet 12. A rotor 13 is rotatable in the housing 10 by a drive 14 (see FIG. 3). A seal 15 engages the rotor 13 and a second inlet 16 leads to the housing 10.

The housing 10 may be formed from a plastics material by a moulding process and may be resilient. The inlet 11 and the outlet 12 are, as seen in FIG. 2, axially aligned and are located to one side of a diameter of the housing 10. The rotor 13 may also be formed from a plastics material and includes four recessed surfaces 17*a*, 17*b*, 17*c*, 17*d* (see FIG. 2) arranged between circular cross-section end portions (one of which is seen at 18 in FIG. 3). The rotor 13 is mounted for rotation within the housing 10 with the circular cross-section end portions 18 being received in correspondingly shaped portions of the housing 10. Where the housing 10 is resilient, the rotor 13 may slightly distend the housing 10 to form a seal between the engaging parts.

The recessed surfaces 17*a*, 17*b*, 17*c*, 17*d* may be concave in planes including the axis of the rotor, as described, for example, in WO2006/027548, and form, with the interior surface 19 of the housing 10, four chambers 20*a*, 20*b*, 20*c* and 20*d* for conveying fluid from the inlet 11 to the outlet 12 in a manner to be described below. Between the recessed surfaces 17*a*, 17*b*, 17*c*, 17*d* are portions 21*a*, 21*b*, 21*c*, 21*d* of the rotor 13 that engage the interior surface 19 of the housing 10.

The housing includes an opening 22 that is filled by the seal 15 whose axial length is at least as great as the axial length of the surfaces 17*a*, 17*b*, 17*c*, 17*d* and that extends, in a circumferential direction, between the periphery of the inlet 11 where it enters the interior of the housing 10 and the periphery of the outlet 12 where it leaves the interior of the housing 10.

The seal 15 is formed from a flexible resilient material and may be co-moulded with the housing 10 in a one-shot or two shot moulding process. The seal 15 is backed by a seal chamber 24 formed by a wall 25 surrounding the opening 22 and having an open end opposite the seal 15 closed by a cap 26.

The second inlet 16 leads into the chamber 24 via the cap 26 and, as seen in FIG. 1, is controlled by a flow control valve 30, a shut-off valve 31 and a check valve 32 arranged in series along the second inlet 16 towards the cap 26. As an alternative, the second inlet 16 may enter the chamber 24 through the wall 25, as seen in FIG. 3. This aligns the axis of the second inlet 16 with the axis of the rotor 13 and so makes it easier to connect the rotor 13 to the drive 14 simultaneously with the connection of the second inlet 16 to a source of fluid. The chamber 24 is provided with an outlet 33 formed by a portion of the housing 10 leading from the wall 25 of the seal chamber 24 to the housing outlet 12 (see FIG. 2). At the housing outlet 12, the chamber outlet 33 is formed with a pressure-reducing constriction 34 for a purpose to be described below.

In use, the inlet 11 is connected to a source of a first fluid, such as a reservoir of liquid. Examples of suitable liquids are drink concentrates and detergents. The second inlet 16 is connected to a source of a second fluid under pressure such as water or another liquid. The first fluid will be at a lower pressure than the second fluid—the first fluid, may, for example, be fed to the inlet 11 by gravity and the second fluid pumped or fed from a pressurised source. The rotor 13 is connected to the drive 14 via a splined connection (see FIG. 3).

The second fluid has its pressure regulated by the flow control valve 30 to a constant pressure. The shut-off valve 31 is provided to allow immediate shut-off of the second fluid when a dosing cycle has been completed and the check valve 32 prevents back flow.

The rotor 13 is rotated by the drive 14 in a clockwise direction, as seen in FIG. 2. The first fluid passes from the inlet 11 to the chamber 20*a* that is covering the inlet 11 to fill the chamber 20*a*. The chamber 20*a* then passes around the housing 10 until it reaches the position of the chamber 20*d* in FIG. 2 when the fluid in the chamber 20*a* exits the outlet 12. Successive chambers 20*b*, 20*c*, 20*d* and so on convey fluid in the same way. In this way the fluid is pumped from the inlet 11 to the outlet 12.

As the rotor 13 rotates, the housing-engaging portions 21*a*, 21*b*, 21*c* and 21*d* prevent circumferential leakage between the chambers 20*a*, 20*b*, 20*c* and 20*d*. The seal 15 ensures that fluid in the chamber 20*a*, 20*b*, 20*c*, 20*d* that is adjacent the outlet 12 is squeezed into the outlet 12 and that fluid cannot leak past from the outlet 12 to the inlet 11. The seal 15 is urged into contact with the rotor 13 by the pressure of the second fluid in the seal chamber 24. The pressure of the second fluid is greater than the pressure of the first fluid so that, as a housing-engaging portion 21*a*, 21*b*, 21*c*, 21*d* engages and passes the seal 15 on rotation of the rotor 13, the seal 15 is urged into the housing 10 against a housing-engaging portion 21*a*, 21*b*, 21*c*, 21*d* and then against the succeeding recessed surface 17*a*, 17*b*, 17*c*, 17*d* before being moved moving radially outwardly again by the rotor 13 as the succeeding housing-engaging portion 17*a*, 17*b*, 17*c*, 17*d* approaches.

The second fluid flows through the seal chamber 24 and through the chamber outlet 33 to the constriction 34. At the constriction 34, the pressure of the second fluid is reduced to a pressure appropriate for mixing with the first fluid in the outlet 12 and to ensure that the pressure of the mixed liquids is insufficient to flow back through the pump between the seal and the rotor engaging surfaces. The second fluid may formed into a spray or jet to assist mixing by profiling the shape of the constriction 34.

In this way, the pump of FIGS. 1 to 3 operates with only two moving parts—the rotor 13 and the seal 15. It is therefore inexpensive to manufacture and reliable in operation. The pressure of the second fluid can be adjusted as required and the constriction 33 designed to give any required pressure and flow pattern to the second fluid as it emerges into the outlet 12. The pump of FIGS. 1 to 3 can be used, for example, to pump a drink concentrate as the first fluid and a diluting liquid, such as water, as the second fluid or water as the first fluid and car wash chemicals as the second fluid. There could also be other janitorial applications where detergent concentrate needs dosing into water or fabric care concentrates into washing machines or medical applications where concentrates need re-constituting into liquid foods. It could also be used to carbonate drinks where the second fluid is $CO_2$ or to foam dairy products using $N_2$ There are a number of variations that could be made to the pump described above with reference to FIGS. 1 to 3. FIG. 4 shows an alternative structure in which parts common to FIGS. 1 to 3 and to FIG. 4 are given the same reference numerals and will not be described in detail.

Referring to FIG. 4, in this embodiment, the outlet 12 T's into the second inlet 16 at a junction 40 to mix the first fluid with the second fluid. Upstream of the T-junction 40 is a flow control valve 41 that reduces the pressure of the second fluid before mixing. Upstream of the valve 41 is a branch 42 from the second inlet 16 leading to the seal chamber 24 and so supplying the second fluid to the seal 15 at full pressure. The outlet 12 contains a check valve 43 to prevent flow back through the outlet 12 to the rotor 13. In this case, therefore, the second fluid is applied to the seal 15 and the outlet 12 in parallel rather than in series, as in FIGS. 1 to 3. In other respects, the pump of FIG. 4 operates as described above with reference to FIGS. 1 to 3. Such an arrangement could be used for example for injecting chemicals into a high pressure water line, for example for water treatment or irrigation purposes or to foam dairy products using $N_2$.

The embodiments described above with reference to FIGS. 1 to 4 are able to accommodate low backpressures in the outlet 12 of the kind that might, for example, be generated where the first fluid is a drink concentrate and the second fluid is diluting water and the combination is dispensed into a cup. Where, however, the second fluid is at higher pressure and/or the combined first and second fluids are not immediately dispensed, a higher back pressure may be generated that could have a propensity to force fluid back through the outlet 12 into the housing 10 to cause leaks past the rotor engaging surfaces 21*a*, 21*b*, 21*c*, 21*d* and past the seal 15. FIG. 5 shows a proposal for dealing with this problem. Parts common to FIGS. 1 to 3, on the one hand, and to FIG. 5, on the other, are given the same reference numerals and will not be described in detail.

Referring to FIG. 5, a check valve 50 is provided in the outlet 12 between the junction of the outlet 12 with the interior of the housing 10 and the constriction 33 and so upstream of the junction between the outlet 12 and the chamber outlet 33. This valve allows fluid flow along the outlet 12 away from the interior of the housing but prevents or restricts reverse flow.

Of course, a similar check valve could be provided in the embodiment of FIG. 4.

In any of the embodiments described above with reference to the drawings, there may be more or less recessed surfaces 17*a*, 17*b*, 17*c* 17*d* and associated housing-contacting portions 21*a*, 21*b*, 21*c*, 21*d*. Although the housing 10 as being right cylindrical, it may, for example, be frusto-conical. The recessed surfaces 17*a*, 17*b*, 17*c* 17*d* may have any convenient shape. They may have a convex surface profile in planes normal to the rotor axis. The drive 14 may be computer controlled together with the flow control valve 30 or 41 and the shut-off valve 31. The seal 15 need not be as described above. It could be formed separately and sealed to the housing 10.

In order to prevent flow from the inlet 11 to the outlet 12 past the seal 15 in the case where there is no supply of the second fluid and the rotor 13 is stationary, a small spring may be provided to apply a small force to the under surface of the seal 15 to urge the seal 15 against the rotor 13.

In a modification shown in broken line in FIG. 2, a one-way valve, shown in broken line at 50 in FIG. 2, (such as an umbrella or duckbill) is positioned in the chamber outlet 33 thereby only allowing fluid to pass into the pump outlet 12 and a second one-way valve, shown in broken line at 51 in FIG. 2, is positioned in the chamber inlet 16 only allowing fluid into the chamber 24. The movement of the seal 15 into and out of the chamber 24 caused by rotation of the rotor 13 changes the volume of the chamber 24 thus, as a result of the presence of the valves 50, 51, pumping a fixed volume of fluid from the inlet 16 through the chamber outlet 33. This arrangement requires a spring means (rubber extrusion), shown in broken line at 52 in FIG. 2, to assist the fluid in actuating the seal 15 as the fluid entering the inlet 16 cannot be at a pressure that would allow the fluid to freely flow through the valves. The spring means 52 may be any suitable spring means of the kind shown and described in WO2013/050491. This arrangement provides a fixed ratio mixing of two fluids. From experimentation, the ratio may, for example, be approximately three parts through the pump from inlet 11 to outlet 12 and one part from inlet 16 to outlet 33.

The action of the outer surface of the seal 15 in the chamber 24 is thus akin to a diaphragm pump so it is not a true fixed displacement pump as the amount of movement of the seal 15 can vary depending, for example, on the back pressure in the outlet 12 which in turn acts on the seal 15.

The invention claimed is:

1. A pump, said pump comprising:

a housing having an inlet and an outlet for a fluid and containing a rotor provided with at least one surface recess that forms with an interior surface of the rotor a chamber that, on rotation of the rotor, conveys fluid from the inlet to the outlet, a flexible seal being provided on or as part of the housing and located between the inlet and the outlet to engage the rotor to prevent fluid passing from the outlet to the inlet, the seal backed by a seal chamber;

a second inlet being provided for the supply of a second fluid to the outlet to mix with fluid in the outlet and also to the seal chamber to apply second fluid to the seal, to urge the seal against the rotor.

2. A pump according to claim 1 wherein the second fluid is supplied to the outlet at a first pressure and is supplied to the seal at a second pressure, the first pressure being less than the second pressure.

3. A pump according to claim 1 wherein the second inlet has a first branch and a second branch, the first branch leading to the chamber and the second branch leading to the outlet.

4. A pump according to claim 3 wherein the second fluid is supplied to the outlet at a first pressure and is supplied to the seal at a second pressure, the first pressure being less than the second pressure; and the second branch includes a regulator for reducing the pressure of the second fluid to said first pressure before passing to the outlet.

5. A pump according to claim 1 wherein the second inlet passes said second fluid into said chamber, the second fluid then exiting said chamber to the outlet.

6. A pump according to claim 5 wherein the second fluid is supplied to the outlet at a first pressure and is supplied to the seal at a second pressure, the first pressure being less than the second pressure; and the second fluid exits the chamber through a chamber outlet, the chamber outlet including a pressure reducing device for reducing the pressure of the second fluid to said first pressure before passing to the outlet.

7. A pump according to claim 6 wherein second inlet and the second outlet include respective non-return valves so that rotation of the rotor to move the seal into and out of the chamber pumps the second fluid from the chamber to the chamber outlet.

8. A pump according to claim 2 wherein the second inlet includes a pressure flow regulator for controlling the pressure of the second fluid to said second pressure.

9. A pump according to claim 1 wherein the second inlet is controlled by a shut-off valve.

10. A pump according to claim 1 wherein a check valve is provided in the outlet upstream of the connection between the second inlet and the outlet to prevent or restrict reverse flow through the outlet.

11. A method of mixing first and second fluids comprising pumping the first fluid from an inlet to an outlet with a pump including a rotor having a flexible seal urged against the rotor, passing the second fluid to urge the seal against the rotor and passing the second fluid to the outlet to mix with the first fluid.

12. A pump according to claim 2 wherein the housing includes a seal chamber surrounding a surface of the seal opposite the surface of the seal engaging the rotor, the second fluid being supplied to said seal chamber to urge the seal against the rotor.

13. A pump according to claim 12 wherein the second inlet has a first branch and a second branch, the first branch leading to the chamber and the second branch leading to the outlet.

14. A pump according to claim 1 wherein the second inlet includes a pressure flow regulator for controlling the pressure of the second fluid to said second pressure.

15. A pump according to claim 2 wherein the second inlet is controlled by a shut-off valve.

16. A pump according to claim 1 wherein the second inlet is controlled by a shut-off valve.

17. A pump according to claim 2 wherein a check valve is provided in the outlet upstream of the connection between the second inlet and the outlet to prevent or restrict reverse flow through the outlet.

18. A pump according to claim 1 wherein a check valve is provided in the outlet upstream of the connection between the second inlet and the outlet to prevent or restrict reverse flow through the outlet.

19. A pump according to claim 9 wherein a check valve is provided in the outlet upstream of the connection between the second inlet and the outlet to prevent or restrict reverse flow through the outlet.

* * * * *